US005349782A

United States Patent [19]

Yulkowski

[11] Patent Number: 5,349,782

[45] Date of Patent: Sep. 27, 1994

[54] DOOR CONSTRUCTION HAVING IMPROVED LOCKING ASSEMBLY

[76] Inventor: Leon B. Yulkowski, 4390 Derry Rd., Bloomfield Hills, Mich. 48302

[21] Appl. No.: 27,784

[22] Filed: Mar. 8, 1993

[51] Int. Cl.[5] ..... E05C 7/04

[52] U.S. Cl. ..... 49/366; 49/368

[58] Field of Search ..... 292/213, 78, 229, 341.17; 49/366, 367, 368, 303, 310, 311, 312

[56] References Cited

U.S. PATENT DOCUMENTS

| | | | |
|---|---|---|---|
| 1,433,442 | 10/1922 | White | 49/368 |
| 1,536,842 | 5/1925 | Halbert | 49/311 |
| 3,077,644 | 2/1963 | Kesling | 49/366 |
| 3,362,108 | 1/1968 | Jones | 49/366 X |
| 3,487,581 | 1/1970 | Ellingson | 49/366 X |
| 3,940,886 | 3/1976 | Ellingson | 49/368 X |
| 3,959,927 | 6/1976 | Good | 49/366 X |
| 3,969,845 | 7/1976 | Yulkowski . | |
| 3,973,289 | 8/1976 | Yulkowski . | |
| 4,093,284 | 6/1978 | Yulkowski . | |
| 4,226,489 | 10/1980 | Haag | 49/366 X |
| 4,428,153 | 1/1984 | Klinger et al. | 49/366 |
| 4,545,607 | 10/1985 | Yulkowski | 292/216 |

FOREIGN PATENT DOCUMENTS

| | | | |
|---|---|---|---|
| 1067336 | 4/1954 | Fed. Rep. of Germany | 292/341.17 |

OTHER PUBLICATIONS

Openings Brochures-A, B.

*Primary Examiner*—Peter M. Cuomo
*Assistant Examiner*—Jerry Redman
*Attorney, Agent, or Firm*—Luis Miguel Acosta

[57] ABSTRACT

A door construction with an improved locking channel assembly has a pair of doors with vertical edges pivotally hinged to a frame and opposing closing edges including an improved interlocking locking channel assembly. The interlocking assembly has first and second elongated locking channel elements lying within the plane of the doors. The locking channel elements extend substantially the height of, and are pivotally attached along respective vertical axis of an associated edge of a door. One locking channel element carries an adjustable elongated tongue. The other elongated locking channel element is adapted to receive the protruding portion of the tongue in interlocking relationship.

18 Claims, 2 Drawing Sheets

DOOR CONSTRUCTION HAVING IMPROVED LOCKING ASSEMBLY

BACKGROUND OF THE INVENTION

The present invention relates to a door construction. More particularly, the present invention relates to a door construction having an improved locking channel assembly which includes a pair of locking channel elements mounted on the closing edges of a pair of doors.

My earlier U.S. Pat. No. 4,545,607 Oct. 8, 1985 for "Door Construction" discloses a door construction having a door hinged to a frame wherein the door has a locking channel which can be released to allow the door to swing to an open position. The locking channel is pivotally mounted upon a vertical axis on the closing edge of the door and extends substantially the height of the door. When the door is closed, the locking channel interlocks with an elongated locking element which also extends substantially the height of the door. Other door constructions are shown in my U.S. Pat. Nos.: 3,969,845 Jul. 20, 1976 for "Door Construction", U.S. Pat. No. 4,093,284 Jun. 6, 1978 for "Door Construction" and U.S. Pat. No. 3,973,289 Aug. 10, 1976 for "Door Hinges." The present invention is in the nature of an improvement of the door constructions shown in my earlier patents.

The present invention is especially well adapted for use in conjunction with pairs of doors which must be well sealed against weather, sound or fire. On traditional pairs of doors, the gap between the two doors is covered by an astragal plate mounted to one of the doors, called the active door. When the active door is in the closed position, the astragal overlaps the inactive door. This traditional door arrangement has numerous disadvantages. First, the astragal is generally considered to be hardware which is supplied separate from the active door, thus necessitating field installation. Also, once mounted, an astragal does not necessarily conform neatly with the inactive door when closed. A poor fit provides a poor weather, sound or fire seal. For effective sealing, a special gasket may be required in addition to the astragal. Furthermore, the overlap of the astragal necessitates the use of a door coordinator so that the inactive door always closes first. If the active door closes before the inactive door, the inactive door will remain ajar, defeating security as well as weather, sound or fire sealing. The inactive/active door construction also requires special hardware such as automatic flush bolts, open back strikes, etc. Special hardware can shorten life cycles, decrease security and/or increase maintenance.

In place of the standard astragal, the present invention employs an adjustable assembly attached to the closing edge and in the plane of the door to adjustably close the space between the closing edges of the two doors, and which forces the two doors into planar alignment. The assembly of this invention interlocks the two doors in a structural mutually supporting manner. The assembly eliminates the need for field mounting requirements for automatic flush bolts, open back strikes or door coordinators. The assembly is robust to sustain abusive loads due to misaligned doors or contact with carts, gurneys, etc. Furthermore, the assembly is easily adjustable to allow compensation for frames which are over or undersized or out of plane due either to manufacturing or inaccurate field setting. These and other advantages of the present invention will be apparent to those skilled in the art from the following disclosure.

SUMMARY OF THE INVENTION

The present invention relates to a pair of doors which have vertical edges pivotally hinged to a frame and have opposing closing edges with an interlocking assembly. In accordance with the present invention, the interlocking assembly is an improved locking channel assembly with first and second elements, preferably elongated locking channels within the plane of the doors. The first locking element extends substantially the height of, and is pivotally attached along a vertical axis to the closing edge of one door. The first locking element carries an elongated tongue support insert which is press fit therein. The tongue support insert receives and supports an elongated tongue which adjustably protrudes from the insert away from the closing edge of the one door. The second elongated locking element extends substantially the height of, and is pivotally attached along, a vertical axis to the closing edge of the other door. The second locking element faces away from the closing edge of the door to which it is attached, and preferably is a channel element carrying a sealing gasket interior of each channel leg and is adapted to receive the protruding portion of the tongue in interlocking relationship.

Further understanding of the present invention will be had from the following description taken in conjunction with the claims and accompanying drawings.

DETAILED DESCRIPTION OF THE PREFERRED EMBODIMENT

Figure 1:
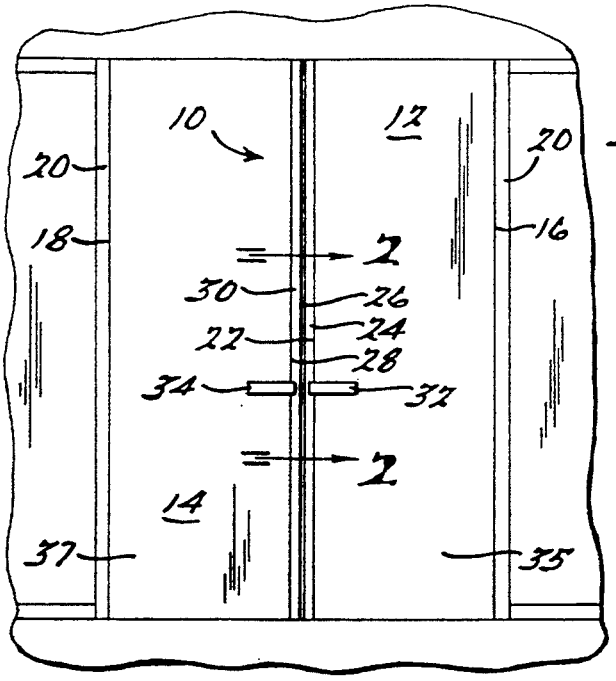
FIG. 1 is a front elevation, broken away, of a pair of doors hinged within a frame and including on their closing edges a preferred embodiment of a lock channel assembly of the present invention.

Now referring to the Figures, a preferred embodiment of a door construction of the present invention is illustrated in FIGS. 1–5 and indicated generally by the numeral 10. Door construction 10 includes a pair of doors 12 and 14, each of which is pivotally hinged at respective vertical edges 16 and 18 to frame 20. Closing edge 22 of door 12 carries elongated locking channel element 24 with tongue 26, while closing edge 28 of door 14 carries elongated locking channel element 30 which receives the protruding portion of tongue 26 in interlocking relationship. Locking channel elements 24 and 30 extend substantially the height of each door 12, 14 and cooperate to selectively interlock the closing edges 22 and 28 of doors 12 and 14 as set forth in more detail hereinafter. Doors 12 and 14 have respective handles 32 and 34, which are operatively connected to locking channel elements 24 and 30 to release them from interlocking engagement, thereby allowing doors 12 and 14 to be opened. Locking channel elements 24 and 30 are a preferred embodiment of a locking channel assembly of this invention.

Figure 4:
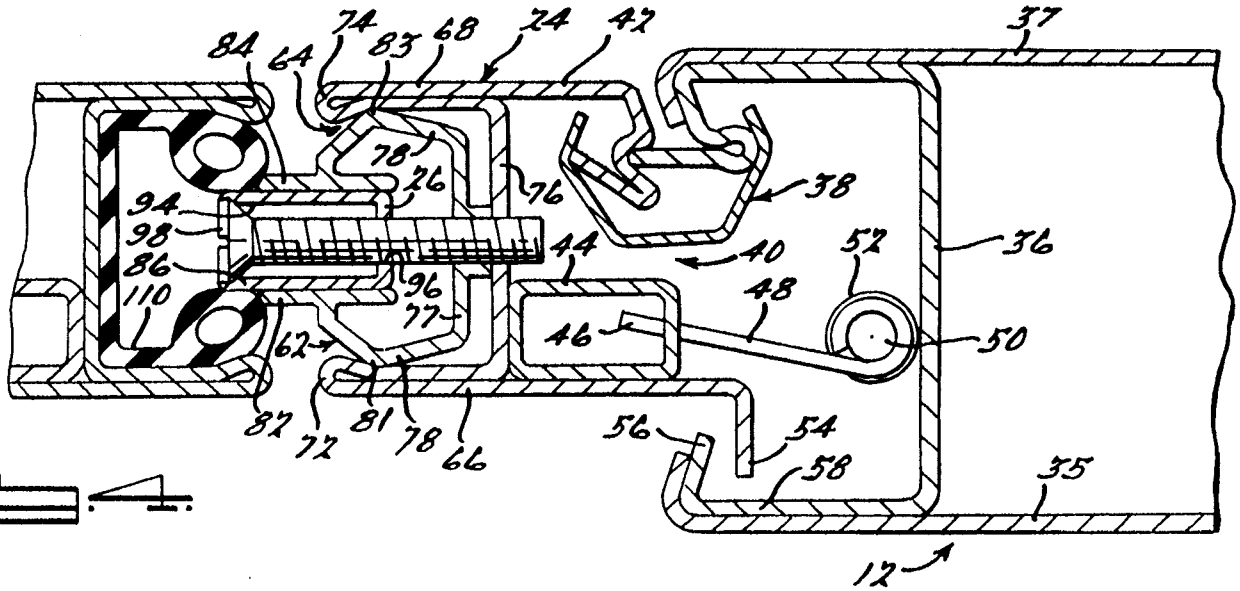
FIG. 4 is a sectional view, broken away, taken along line 4—4 in FIG. 2, showing a threaded fastener of the locking channel and illustrating the lock channel assembly in closed, interlocked position.
Figure 5:
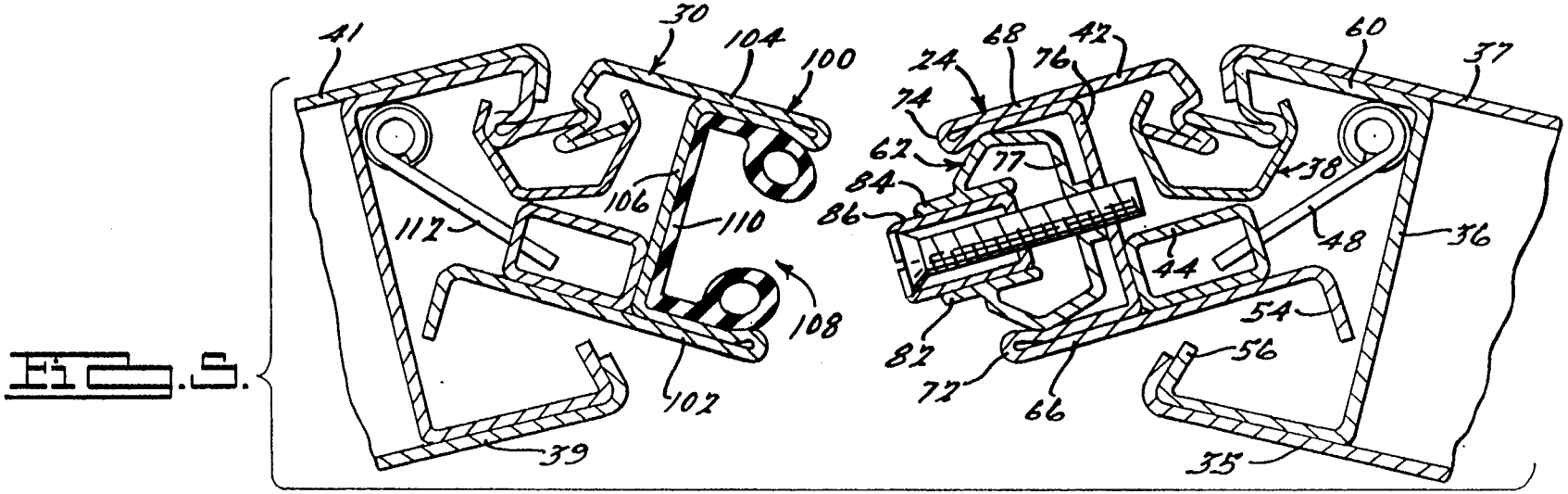
FIG. 5 is a sectional view analogous to FIG. 4 but showing the lock channel assembly in open, unlocked position.

The present invention is in the nature of an improvement of the door construction shown in my earlier U.S. Pat. No. 4,545,607, Oct. 8, 1985 "Door Construction," the disclosure of which is specifically incorporated by reference herein. The present invention is particularly directed to an improved locking channel assembly for use in a door pair. The locking channel assembly comprises locking channels 24 and 30 which are each pivotally attached to the respective closing edges of a pair of doors generally as is disclosed with respect to the locking channel in my earlier U.S. Pat. No. 4,545,607. Doors 12 and 14 have flush door panels 35, 37, 39 and 41 which can be a laminate, wood veneer, stainless steel, aluminum or the like sheet material. As is shown in FIGS. 4 and 5, extending along the closing vertical edges of panels 35 and 37 is channel-shaped insert 36, one leg of which is hingedly connected by hinge clip 38 to locking channel 24 which is pivotally attached thereto about a vertical axis. Insert 36 is preferably made of steel. Locking channel element 24 is also preferably made of steel and has an inwardly, i.e., rightwardly as viewed in FIG. 4, open channel 40 with one leg 42 hingedly connected to hinge 38. Secured as by welding within channel 40 is elongated steel tube 44 into which extends the leftward edge portion 46 of blocking member 48. The rightward edge of blocking member 48 carries pivot pin 50 which rotatably carries nylon roller 52. Pivotal movement of locking channel 24 is limited in one direction by channel stop 54 abutting against inwardly bent edge 56 of leg 58 of channel insert 36 and in the other direction by blocking member 48 abutting against leg 60 of channel insert 36. Locking channel element 24 is selectively released to allow pivotal movement by an actuator (not shown) which is in operative association with blocking member 48.

When the actuator is moved to an unlatched position by manipulations of the associated handle 32, blocking member 48 is moved to a release position and locking channel 24 pivots to an unlocked angular position as shown in FIG. 5.

The foregoing description of door 12 and locking channel element 24 is also applicable to the analogous parts of door 14 and locking channel element 30. Further understanding of the relationship between locking channel elements and their associated blocking members and actuators can be had by reference to my above referenced U.S. Pat. No. 4,545,607, the disclosure of which is specifically incorporated herein.

The locking channel assembly of the present invention comprises locking channel element 24 and locking channel element 30. Generally speaking, locking channel element 24 carries tongue support 62 and adjustable tongue 26. Adjustable tongue 26 is received within locking channel element 30 to interlock locking channel elements 24 and 30.

Locking channel element 24 has a leftwardly as viewed in FIG. 4 open channel mouth 64 formed by legs 66 and 68 and base web 76. Legs 66 and 68 are preferably formed from reentrently bent sheet material as shown in FIG. 5 to provide enlarged ends 72 and 74 with slightly reduced channel width therebetween. Elongated tongue support 62 is press fit between legs 66 and 68 of locking channel element 24 and has a base wall 77 joining outwardly bent legs 78 and 80 which are bent inwardly at 81 and 83 respectively. Legs 78 and 80 are captured by enlarged ends 72 and 74 of legs 66 and 68 of locking channel 24. The outwardly (leftwardly as viewed in FIG. 4) extending ends of legs 78 and 80 carry arms 82 and 84 respectively. Tongue 26 is clampingly engaged between arms 82 and 84, it being appreciated that arms 82 and 84 are biased inwardly towards each other by legs 78 and 80 which legs are also biased inwardly by legs 66 and 68 of locking channel element 24.

Figure 2:
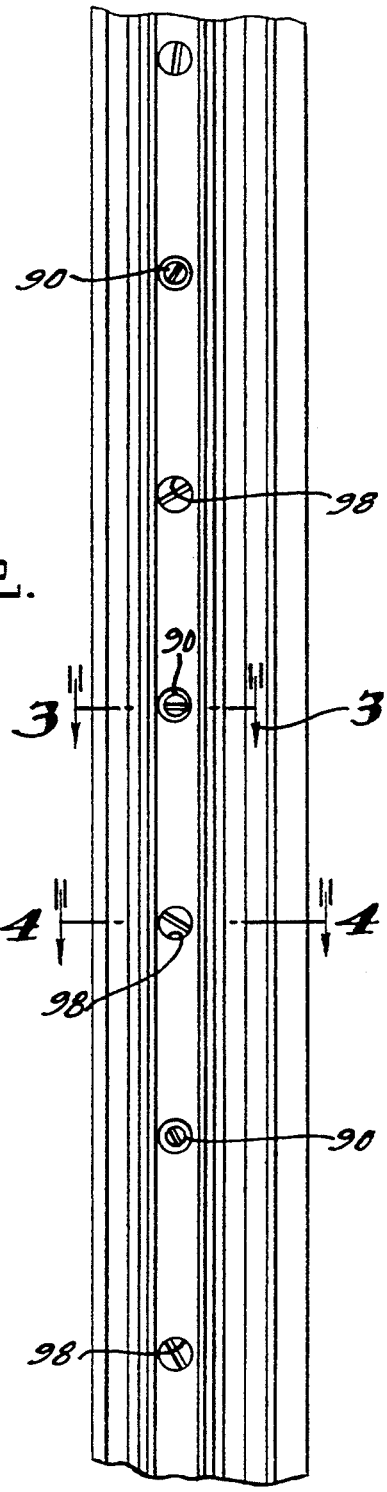
FIG. 2 is an end view, broken away, of one of the pair of doors looking in the direction of arrows 2 in FIG. 1.
Figure 3:
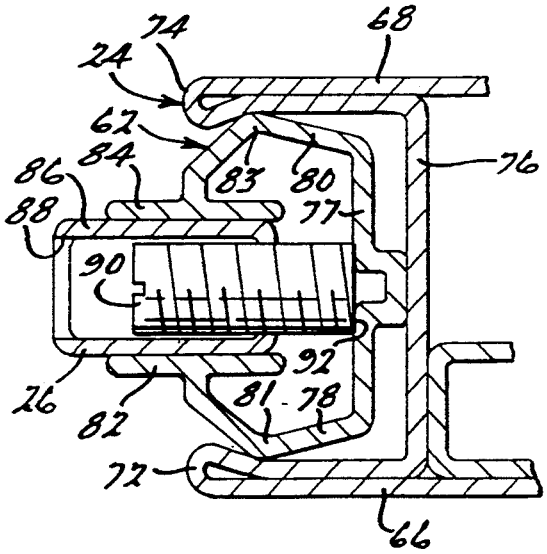
FIG. 3 is a sectional view, broken away, taken along line 3—3 in FIG. 2 and showing a set screw which allows adjustment of the tongue of the locking channel.

Elongated adjustable tongue 26 is a rectangular steel tube press fit between arms 82 and 84 with a portion 86 extending leftward as viewed in FIGS. 3–5 beyond arms 82 and 84 to selectively interlock with locking channel element 30. As best shown in FIGS. 2 and 3, tongue 26 has a plurality of apertures 88 through which threadably extend a corresponding plurality of set screws 90 having forward ends 92 in abutting relationship with wall 77 of tongue support 62. As best shown in FIGS. 2 and 4, tongue 26 also has a plurality of aligned pairs of apertures 94 and 96 through which threaded fasteners 98 extend to secure tongue 26, and tongue support 62 to web 76 of locking channel element 24. Thus, set screws 90 can be turned to adjust the distance of set off of tongue 26 from wall 77 of tongue support 62. The plurality of set screws 90 vertically spaced along the height of tongue 26 allows for adjustment of tongue 26 slightly from the vertical axis to accommodate misaligned doors.

Locking channel element 30 has a channel-shaped cross-section 100 formed by legs 102 and 104 and base web 106. Locking channel element 30 has a leftwardly open mouth 108 as viewed in FIGS. 4 and 5 and secured within locking channel element 30 is a sealing gasket 110. As best shown in FIG. 4, locking channel 30 is adapted to receive the leftwardly protruding portion of tongue 26 therein to interlock locking channel elements 24 and 30 and hence the closing edges of doors 12 and 14.

Doors 12 and 14 are released for opening pivotal movement by actuator (not shown) moving blocking members 48 and 112 to the position shown in FIG. 5. Such movement of blocking members 48 and 112 pivots locking channel elements 24 and 30 to the release positions shown in FIG. 5 which, in turn, releases the closing edges of doors 12 and 14, allowing them to open.

It will be appreciated that the above description of a preferred embodiment of the present invention is intended to well illustrate the concept of the present invention. However, it will be further appreciated that the present invention is subject to variation and modification within the skill of the art and it is intended that such modifications and variations are to be considered within the scope of the present invention which is to be limited only by the scope of the following claims.

What is claimed is:

1. A pair of doors hinged to a frame and having closing edges interlocked by a locking assembly, said locking assembly comprising:

a first locking element movably mounted on the closing edge of one of said pair of doors;

a substantially continuous tongue support secured within said first locking element, said tongue support having a pair of clamping arms in opposing parallel relationship;

an elongated tongue with a portion thereof clampingly held between said clamping arms and a portion thereof protruding beyond said first locking element; and a second locking element movably mounted on the closing edge of the other of said pair of doors and adapted to receive in interlocking engagement said protruding portion of said tongue when said pair of doors are in closed relationship;

said first and second locking elements being sufficiently moveable relative to the associated doors that said elements disengage upon selective movement so the doors may open.

2. A pair of doors as in claim 1 wherein said second locking element has a sealing gasket secured in said element.

3. A pair of doors as in claim 1 wherein said tongue has a plurality of screws extending therethrough, said screws having an abutting relationship with a member immovable with respect to said first locking element to thereby adjustably set off said tongue from said first locking element.

4. A pair of doors as in claim 3 wherein said tongue has a plurality of fasteners extending horizontally therethrough.

5. A pair of doors as in claim 4 wherein said first locking element has a channel shaped cross-section having a pair of generally parallel legs joined by a base web, each of said legs being formed by a reentrently bent metal sheet forming an enlarged end thereby reducing the width between legs at the mouth of the channel; and said tongue support is generally channel-shaped in cross-section having a pair of outwardly bowed legs joined by a base wall, said legs being captured between the enlarged ends of said legs of said first locking element.

6. A pair of doors as in claim 5 wherein said legs of said tongue support carry opposing generally parallel clamping arms and said tongue is clampingly held between said clamping arms.

7. A pair of doors hinged to a frame and having closing edges selectively interlocked by a locking assembly, said locking assembly comprising:

a first locking element with a channel-shaped cross-section having a pair of generally parallel legs joined by a base web, each of said legs being formed by a reentrently bent metal sheet forming an enlarged end thereby reducing the width between legs at the mouth of the channel, said first locking element movably mounted on the closing edge of one of said pair of doors;

a substantially continuous tongue support secured within said first locking element, said tongue support with a generally channel-shaped cross-section having a pair of outwardly bowed tongue support legs joined by a base wall, said tongue support legs being captured between the enlarged ends of said legs of said first locking element, said tongue support legs carrying opposing, generally parallel clamping arms;

an elongated tongue clampingly held between said clamping arms with a portion of said tongue protruding beyond said first locking element; and a second locking element movably mounted on the closing edge of the other of said pair of doors and adapted to receive in interlocking engagement said protruding portion of said tongue when said pair of doors are in closed relationship;

said first and second locking elements being sufficiently moveable relative to the associated doors that said elements disengage upon selective movement so the doors may open.

8. The pair of doors of claim 7 wherein said second locking element comprises a channel and a sealing gasket secured in said channel.

9. The pair of doors of claim 7 wherein said tongue comprises a plurality of adjustable fasteners, said fasteners having an abutting relationship with at least one of said base web or said base wall to thereby adjustably set off said tongue from said first locking element.

10. The pair of doors of claim 9 wherein said second locking element comprises a channel and a sealing gasket secured in said channel.

11. In a pair of doors hinged to a frame, each of said doors having a locking element movably mounted upon its closing edge aligned with the door and interlocked with the other of said locking elements, each of said locking elements being in sufficiently movable relation to the door that it selectively disengages said other locking element so that the door may open, each of said locking elements having an associated blocking means movably mounted on the associated door in one position retaining the element in a locked position and in another position releasing the element to allow the door to open;

the improvement comprising:

a first of said locking elements having a tongue support and a tongue;

a second of said locking elements being disposed in facing relationship to said first locking element and adapted to receive said tongue in interlocking relationship;

said first locking element with a channel-shaped cross-section having a pair of generally parallel legs joined by a base web, each of said legs being formed by a reentrently bent metal sheet forming an enlarged end thereby reducing the width between legs at the mouth of the channel;

said tongue support with a generally channel-shaped cross-section having a pair of outwardly bowed tongue support legs joined by a base wall, said tongue support legs being captured between the enlarged ends of said legs of said first locking element, said tongue support legs carrying opposing, generally parallel clamping arms;

said tongue being clampingly held between said clamping arms.

12. The pair of doors of claim 11 wherein said second locking element comprises a channel and a sealing gasket secured in said channel.

13. The pair of doors of claim 11 wherein said tongue comprises a plurality of adjustable fasteners, said fasteners having an abutting relationship with at least one of said base web or said base wall to thereby adjustably set off said tongue from said first locking element.

14. The pair of doors of claim 13 wherein said second locking element comprises a channel and a sealing gasket secured in said channel.

15. A locking channel assembly for a pair of doors having a first locking channel element with a tongue support and a tongue, and a second locking channel element receiving said tongue of said first locking channel element in interlocking relationship;

said first locking element with a channel-shaped cross-section having a pair of generally parallel legs joined by a base web, each of said legs being formed by a reentrently bent metal sheet forming an enlarged end thereby reducing the width between legs at the mouth of the channel, said first locking element movably mounted on the closing edge of one of said pair of doors;

said tongue support with a generally channel-shaped cross-section having a pair of outwardly bowed tongue support legs joined by a base wall, said tongue support legs being captured between the enlarged ends of said legs of said first locking element, said tongue support legs carrying opposing, generally parallel clamping arms;

said tongue having a plurality of adjustable fasteners, said fasteners having an abutting relationship with at least one of said base web or said base wall to thereby adjustably set off said tongue from said first locking element, said tongue being clampingly held between said clamping arms.

16. The pair of doors of claim 15 wherein said second locking element comprises a channel and a sealing gasket secured in said channel.

17. The pair of doors of claim 15 wherein said tongue comprises a plurality of adjustable fasteners, said fasteners having an abutting relationship with at least one of said base web or said base wall to thereby adjustably set off said tongue from said first locking element.

18. The pair of doors of claim 15 wherein said second locking element comprises a channel and a sealing gasket secured in said channel.

* * * * *